United States Patent [19]

Tremmel

[11] Patent Number: 5,049,286

[45] Date of Patent: Sep. 17, 1991

[54] PROCESS FOR PURIFICATION OF NICKEL PLATING BATHS

[75] Inventor: Robert A. Tremmel, Grosse Ile, Mich.

[73] Assignee: OMI International Corporation, Warren, Mich.

[21] Appl. No.: 456,020

[22] Filed: Dec. 22, 1989

[51] Int. Cl.[5] ..... C02F 1/72; C02F 1/58

[52] U.S. Cl. ..... 210/759; 210/694; 210/724; 204/49; 204/DIG. 13

[58] Field of Search ..... 204/DIG. 13, 49; 210/758, 759, 754, 690, 694, 724

[56] References Cited

U.S. PATENT DOCUMENTS

| | | | |
|---|---|---|---|
| 3,122,490 | 2/1964 | Strauss | 204/DIG. 13 |
| 4,067,785 | 1/1978 | Pluss et al. | 204/49 |
| 4,120,859 | 10/1978 | Pluss et al. | 204/49 |
| 4,696,749 | 9/1987 | Habermann et al. | 210/759 |

OTHER PUBLICATIONS

*The Merck Index,* 10th Ed. (1983), p. 7545.

*Nickel and Chromium Plating,* J. K. Dennis, T. E. Such, John Wiley & Sons, pp. 143 and 109 (1972).

*Primary Examiner*—Stanley S. Silverman

*Assistant Examiner*—Neil M. McCarthy

*Attorney, Agent, or Firm*—Richard P. Mueller

[57] ABSTRACT

An improved process for purifying a nickel plating bath including a pyridine composition as an additive and which bath contains a breakdown product of the pyridine composition. The process has the following steps:

a. adjusting the pH of the nickel plating bath to a pH of equal to or greater than 5.0;

b. adding an effective amount of an oxidizing agent; and c. removing the breakdown product from the nickel plating bath.

22 Claims, No Drawings

PROCESS FOR PURIFICATION OF NICKEL PLATING BATHS

BACKGROUND OF THE INVENTION

The present invention relates to the purification of depleted bright nickel electroplating baths.

Brighteners and leveling agents are commonly added to nickel plating baths to produce improved brightness and leveling of the plating layer in the final nickel plated article. Pyridine compositions such as 1-(3-sulfopropyl)-pyridinium betaine (PPS) or 1-(3-sulfo-2-hydroxy-propyl)-pyridinium betaine are commonly used as additives for this purpose.

During the typical extended use of commercial plating baths containing pyridine brightening and leveling agents, the performance of the bath decreases until the bath has degraded to such an extent that it is necessary to rejuvenate or replace the bath. As a result of this degradation, the brightening and leveling characteristics of the bath are dramatically reduced or may be reduced to such an extent that the bath is no longer viable for electroplating.

There have been several types of methods attempted in the past to remedy this depleted condition. For example, in the early stages of degradation the mere addition of more pyridine agents will temporarily improve the bath. However, the bath will eventually further degrade to such an extent that further additions will no longer improve the condition of the bath. Other methods include treating the bath with activated charcoal and filtration of the bath. While these methods are again adequate at the initial degradation states, the bath eventually becomes untreatable in this manner and may have to be entirely replaced. A more complex method of rejuvenation is shown in U.S. Pat. No. 3,122,490 which includes the addition of sultones and lactones while heating the bath to relatively high temperatures for regeneration of the bath. While this process may have somewhat improved results over the activated carbon and filtration processes, the process is not universally commercially practical since most tank linings cannot tolerate the temperature requirements.

Therefore, there has been a need in the art to provide a method for purification of such a degraded nickel bath which will allow increased life of the nickel bath without adversely effecting the basic function thereof.

SUMMARY OF THE INVENTION

The present invention provides an improved process for purifying a nickel plating bath which includes a breakdown product of the pyridine composition. The processes of the present invention include the steps of first adjusting the pH of the nickel plating bath to a pH of greater than at least about 5. Thereafter, an effective amount of an oxidizing agent is added to the nickel plating bath. The treated breakdown product is then removed from the nickel plating bath.

Therefore, it is at least one object of the present invention to provide a process for removing the breakdown product of the pyridine compound from the nickel plating bath for rejuvenating the nickel plating bath.

DETAILED DESCRIPTION OF THE INVENTION

In the present invention the inventor has a solution to the degradation problem associated with certain nickel plating baths apparently due to the breakdown product of pyridine additives.

Generally speaking, the present invention comprises an improved process for purifying a nickel plating bath which includes a pyridine compound as an additive and contains impurities which are a breakdown product of the pyridine compound. Generally speaking, the present invention includes the steps of:

a. adjusting the pH of the nickel plating bath to a pH of greater than about 5;
b. adding an effective amount of an oxidizing agent or agents to the nickel plating bath; and
c. removing the breakdown product from the nickel plating bath.

The present invention may be utilized for and is particularly useful in purifying degraded WATTS or high chloride-type nickel plating baths commonly employed in the electroplating industry today. While WATTS-type baths are or were considered to have a very specific composition, it will be appreciated that currently such baths are considered to comprise, and the methods of the present invention are therefor useful in, baths employing about 200 to about 400 grams per liter of $NiSO_4.6H_2O$; about 30 to about 100 grams per liter of $NiCl_2.6H_2O$; and about 30 to about 60 grams per liter of $H_3BO_3$. A typical WATTS-type bath may more specifically include the following components: 300 g/l $NiSO_4.6H_2O$; 60 g/l $NiCl_2.6H_2$; and 40 g/l of $H_3BO_3$. The WATTS-type baths typically have a pH of about 2.5 to about 5 and operate at a temperature range of about 80° F. to about 160° F. As noted above, the methods of the present invention are also useful in "high chloride"-type nickel baths. These typically employ 0–100 g/l of $NiSO_4.6H_2O$; about 150 to about 300 g/l of $NiCl_2.6H_2O$ and about 30 to about 60 g/l of $H_3BO_3$. Likewise, these baths may more typically contain about 60 g/l of $NiSO_4.6H_2$; 225 g/l of $NiCl_2.6H_2O$; and about 40 g/l of $H_3BO_3$.

As noted above, such WATTS-and high chloride-type nickel baths frequently contain brighteners and leveling agents. Many of these, such as TURBO MAINTENANCE, contain pyridine-based components along with acetylenic alcohols. The baths include a pyridine brightening and leveling additive such as a 1-(3-sulfopropyl)-pyridinium betaine, commonly known as "PPS". Other pyridine compositions which are employed as brighteners and the process of the present invention is equally effective include 1-(3 sulfoethyl) -pyridinium betaine and 1-(2-hydroxy-3-sulfopropyl) pyridinium betaine, wherein the betaine moiety contains a straight or branched chain alkyl moiety having from one to about six carbon atoms ($C_1$–$C_6$) in the above pyridine compositions.

As noted, during plating operations the PPS compound or component tends to breakdown into a degraded product which is believed to be a betaine of piperidine, e.g., 1-(3-sulfopropyl)piperidine betaine. The present invention provides an improved method for regenerating the bath to purify the solution by removing such degradation products of pyridine compounds from the solution without significant detrimental effects on the treated bath.

In the first step of the present invention, it is critical that the pH of the bath be raised above a pH of about 5.0 for operation of the process of the present invention. Typically the pH of the bath will be from about 5.0 to about 6.0 and preferably in the range of from about 5.0 to about 5.5. The pH of the bath may be raised by any suitable method, such as the addition of an alkaline composition which will not adversely effect the characteristics of the present invention or the efficiency of the electrical plating bath in its intended final use. Suitable alkaline materials include carbonates and bicarbonates, such as the carbonates or bicarbonates of sodium, magnesium or nickel; mixture of these materials may also be employed. In a preferred embodiment nickel carbonate is utilized since it is most compatible with the nickel plating bath solution. During addition of the alkaline material the bath is agitated or stirred in order to insure complete equilibrium of the solution at or above a pH of about 5.0. In a typical commercial embodiment, this usually requires from about one-half to about one hour of agitation of the solution.

According to the second step of the present invention, after adjusting the pH of the bath, an effective amount of one or more select oxidizing agents are added to the bath solution. It has been discovered that only a select group of oxidizing agents will work in the processes and methods of the present invention; not all commonly-employed or art-disclosed oxidizing will work. Oxidizing agents which are useful for use in the present invention include perborates, perchlorates, periodates, perbromates, and mixtures thereof. Those that have been observed not to work include hydrogen peroxide, sodium peroxide, sodium permanganate, potassium permanganate, sodium percarbonate and sodium chlorate; thus the selection nature of this invention is clear. Preferred oxidizing agents include potassium perborate, potassium perchlorate, sodium perborate, sodium perchlorate, and mixtures thereof. The oxidizing agent should also be added to the bath with vigorous mixing or agitation in order to ensure complete reaction with the degradation product of the pyridine compound. Typically, the oxidizing agents should be agitated in a typical commercial bath solution for about one half-hour. Oxidizing agents should be added in an amount of generally from about 1 g/l to about 10 g/l typically from about 2 g/l to about 8 g/l and preferably from about 4 g/l to about 6 g/l. It will be appreciated that these useful oxidizing agents or materials have a wide range of molecular weights. Accordingly, the weight per volume numbers given above are somewhat flexible. In general, however, these levels translate into about 0.004 to about 0.15 moles per liter. In a highly preferred embodiment, these oxidizing agents or materials are employed at a level of about 0.02 to about 0.075 moles per liter.

In accordance with the third of the present invention, the breakdown product of the pyridine composition is thereafter removed from the bath. In a preferred embodiment of this step a suitable quantity of an activated carbon (typically from about 6 g/l to about 8 g/l) is added to the bath and allowed to stand for at least two hours, and preferably for at least about eight to about twelve hours. In a preferred embodiment, the activated carbon is added at a level of about 4 to about 10 grams/liter, more preferably, about 6 to about 8 grams/liter, and still more preferably about 7 g/l. Thereafter, the solution may be filtered in any conventional or art-disclosure manner. In an alternate embodiment of the present invention, a method is also provided for additionally preventing a "blue clouding effect" which sometimes occurs in bath solutions treated by this or similar processes. To prevent the appearance of "blue clouds" in the final plating, a permanganate compound is added in an effective amount after addition of the oxidizing agent. Preferred permanganate salts include sodium, potassium, mixtures thereof, and the like. Potassium permanganate is a highly referred permanganate salt. Potassium permanganate is added in an amount of generally from about 0.025 g/l to about 0.5 g/l, preferably from about 0.1 g/l to about 0.2 g/l, and more preferably from about 0.125 g/l to about 0.15 g/l, and mixed well in the bath. Thereafter, the bath is allowed to stand from at least one-half hour to one hour preferably for at least about eight to about twelve hours prior to the steps of addition of activated carbon and filtration. This step acts to prevent the formation of "blue clouds" which are commercially undesirable and which also act to intensify the oxidation process thereby improving the overall result of the present process. After completing the process the bath may be prepared for normal operation by adjusting the pH of the solution to a level of about 4.0 and adding an effective amount of sodium saccharin and the preferred pyridine compound, which is usually PPS, to adjust the solution to operable levels. The pyridine compound such as PPS addition may be in the form of a commercially available addition which was used in previous additions to the bath or it may be of the type particularly suited for this use such as the TURBO MAINTENANCE additive produced by OMI International Corporation, 21441 Hoover Road, Warren, Mich. and commercially available from OMI. The amount of sodium saccharin added back to the solution may be up to its saturation level in the bath. Since even large additions of sodium saccharine are not detrimental, the particular amount added will normally be dictated by economic considerations. Generally, the amount added is not in excess of about 30 g/l, however, with amounts up to about 5 g/l being typical and amounts of about 0.5–2 g/l being particularly preferred. After the bath is replenished and the pH and temperature are adjusted to levels appropriate for the application, the electroplating bath may be used in a conventional manner. Further understanding of the present invention can be had from the following illustrative examples and following claims.

EXAMPLE I

A one gallon sample of a depleted commercial bath containing very high concentrations (approximately 200 PPM) of PPS and consequently very high amounts of degradants was obtained and was tested for comparison as follows. Hull Cell (brass) panels were plated, using air agitation, for ten minutes at about two amps. A one inch wide band was scratched the length of the bottom of the panel with a red scotch bright pad so that both brightness and leveling could be measured. Leveling was measured in the 80 ASF to 100 ASF range against prepared standards, whereby a "leveling factor" (LF) of one represents no leveling and 12 is perfect leveling. Original panels had an LF of 5½. The addition of 0.125% of the secondary brightener TURBO MAINTENANCE only increased the LF to 6. Thus, the bath sample taken is too contaminated with degradants to respond to conventional brightener techniques. The PPS concentration after the add was about 235 PPM.

A sample of the depleted bath was treated as follows. The pH of the sample was first increased to 5.1 with small additions of sodium carbonate. Three grams per liter of sodium perchlorate ($NaClO_4$) was added and stirred for one half hour. Seven grams per liter of activated carbon was added and the solution was agitated for one hour. The bath was then filtered and the pH was reduced to a pH of from 4.0 to 4.2. The treated bath was then panel treated as described above. The LF factor of the panel plated with the bath solution treated in accordance with the method of the present invention was 7.0 and the overall deposit was clean and bright. 0.125% of the brightener TURBO MAINTENANCE was then added to the treated solution. The LF factor increased to 9.0. The PPS concentration was analyzed and it had decreased to 155 parts per million leaving the concentration of approximately 190 PPM with the addition of the TURBO MAINTENANCE brightener. Thus, even though the PPS concentration was lower in the final sample, the leveling factor after treatment was substantially improved. The process was repeated on the treated solution using the same steps outlined above. After treatment the PPS was analyzed at 105 parts per million and the panel test indicated that the leveling factor to be 8.0. The addition of 0.125% TURBO MAINTENANCE increased the leveling factor to 11 with a total PPS concentration of 140 parts per million. Thus, the process of the present invention substantially restored the lost leveling and brightness properties of the solution.

EXAMPLE II

Hull Cell panels were plated from a degraded commercial bath which had the following properties. The PPS level was 220 ppm. The deposit from the bath as received was overall bright and ductile, and the leveling factor (LF) was 6½ in the high current density (HCD) area of the Hull Cell (80–100 ASF) and 3½ in the intermediate current density (ICD) area (15–25 ASF). 0.125% of TURBO MAINTENANCE nickel brightener was added and the leveling increased to 8½ (HCD) and 4½ (ICD) and the deposit was brittle. Another 0.125% of TURBO MAINTENANCE did not improve leveling.

A 500 cc sample of the above solution was taken. The degraded solution was treated as follows. The pH of the solution was adjusted to 5.0 with additions of sodium bicarbonate. 3 g/l of sodium percarbonate was added, stirring for ½ hour. 5 g/l of activated carbon was added. The solution was stirred for one half hour and was allowed to settle overnight. The solution was then filtered, 0.5 g/l sodium saccharin was added, and the pH and bath temperature adjusted to desired operating levels.

Leveling and brightness of plated panels were repeated as above and results were similar to the untreated samples.

EXAMPLE III

The procedure of Example II was repeated on a new sample with the exception that 6 g/l of sodium percarbonate was used. The results were similar to those of Example II. These results, along with those of Example II, clearly demonstrate the unique nature of sodium perchlorate, one of the select preferred agents.

EXAMPLE IV

The procedure described in Example II was repeated with the exception that the percarbonate was replaced with sodium perborate. Results showed only marginal improvement in leveling and brightness.

EXAMPLE V

Example IV was repeated except that the amount of sodium perborate was increased to 6 g/l. After filtration and pH adjustment to 4.0, 0.125% of TURBO MAINTENANCE was added. The subsequent panel had an HCD LF of 10 and an ICD LF of 6. A significant improvement in the leveling factor of the solution was shown. The brittleness of the deposit had improved from the untreated solution as the deposit was only slightly brittle.

EXAMPLE VI

Another commercial bath was evaluated as described in Example V. Again a noticeable improvement in leveling was observed. However, an HCD blue cloud was present on the panel. A repetition of the test with this bath and another commercial bath gave the same HCD cloud.

EXAMPLE VII

The commercial bath in Example VI was treated to prevent blue cloud formation as follows. The pH was adjusted to 5.0 with the addition of $NaHCO_3$. 6 g/l of sodium perborate was added and the solution was stirred for one half hour. 0.25 g/l $KMNO_4$, was added and the solution was stirred for ½ hour. 5 g/l of activated carbon was added, the solution was stirred for ½ hour and allowed to settle overnight. The solution was then filtered. The pH was adjusted to 4.0. 0.125% of TURBO MAINTENANCE was added along with ½ g/l sodium saccharin.

Panel tests indicated that HCD leveling factor increased from 6½ to 11 and ICD leveling from 3 to 6. The deposit was cloud free and ductile.

Sodium perborate ($BNaO_3$) produces good results with respect to improved leveling, but in some cases causes HCD blue clouds. This can be overcome by incorporating $KMNO_4$ as part of the process.

EXAMPLE VIII

Example V was repeated replacing the sodium perborate with an equivalent amount of hydrogen peroxide. All other test procedures are the same. Panel test results showed a very minimal improvement in brightness and leveling.

COMPARATIVE EXAMPLES

EXAMPLE IX

The procedure of Example I was repeated with the exception that the pH of the solution was raised to only 4.5. The solution was tested for leveling factor and showed no improvement over the untreated solution.

EXAMPLE X

The procedure of Example I was repeated with the exception that the pH of the solution was raised to only 4.9. The solution was tested for leveling factor characteristics and was found to show only a marginal improvement over the untreated solution.

What is claimed is:

1. An improved process for purifying a nickel plating bath solution including a pyridine composition as an additive, the solution containing an impurity comprising a breakdown product of the pyridine composition, comprising the steps of:

a. adjusting the pH of the nickel plating bath to a pH of equal to or greater than about 5.0;
b. adding an effective amount of an effective oxidizing agent selected from the group consisting of perborates, perchlorates, perbromates, periodates and mixtures thereof to the nickel plating bath; and
c. removing the breakdown product from the nickel plating bath.

2. The improved process of claim 1 wherein step c further comprises the addition of activated carbon and filtration of the nickel plating bath.

3. The improved process of claim 1 wherein said oxidizing agent is selected from the group consisting of potassium perborate, potassium perchlorate, sodium perborate, and sodium perchlorate.

4. The improved process of claim 1 further comprising the step of reactivating to operable levels the nickel plating bath by the further steps of:
a. adjusting the pH of the nickel plating bath to a pH of about 4.0 following step c; and
b. adding an effective amount of a pyridine composition and sodium saccharin to the solution.

5. The improved process of claim 1 further comprising the step of adding a permanganate to the bath after the addition of the preferred oxidizing agent.

6. An improved process for purifying a nickel plating bath solution, including a pyridine composition as an additive, the solution containing an impurity comprising a breakdown product of the pyridine composition, comprising the steps of:
a. adjusting the pH of said bath from about 5.0 to about 6.0;
b. adding sodium perborate to said bath;
c. mixing said sodium perborate into said bath;
d. allowing said bath to stand for at least one half (½) to about two (2) hours; and
e. filtering saio bath for removing precipitated impurities.

7. The improved process for purifying a nickel bath of claim 6, further comprising, following step c the steps of:
a. adding potassium permanganate; and
b. mixing said potassium permanganate with said bath.

8. The improved process for purifying a nickel plating bath of claim 6, further including the step of replenishing the concentration of said bath's ingredients to an operating level.

9. The improved process for purifying a nickel plating bath of claim 7, further including the steps of replenishing the concentration of said bath's ingredients to an operating level.

10. The improved process of claim 6 wherein said bath comprises a pyridine compound.

11. The improved process of claim 10 wherein said bath includes 1-(3-sulfopropyl)-pyridinium betaine.

12. The improved process for purifying a nickel plating bath of claim 6 wherein the pH of said bath is adjusted from about 5.0 to about 6.0 by adding sodium bicarbonate.

13. The improved process for purifying a nickel plating bath of claim 6 further comprising adding activated carbon to said bath.

14. The improved process for purifying a nickel plating bath of claim 13, wherein about 4 g/l to about 10 g/l activated carbon is added to said bath.

15. The improved process for purifying a nickel plating bath of claim 6 wherein from about 4 g/l to about 6 g/l of sodium bicarbonate is added to said bath.

16. The improved process for purifying a nickel plating bath of claim 13 further comprising the step of adjusting the pH to about 4.0 after step e.

17. The improved process for purifying a nickel plating bath of claim 16 further comprising the step of adding up to about 5.0 g/l of sodium saccharin.

18. The improved process for purifying a nickel plating bath of claim 7 further comprising adding activated carbon to said bath.

19. The improved process for purifying a nickel plating bath of claim 18 wherein about 4 g/l to about 10 g/l activated carbon is added to said bath.

20. The improved process for purifying a nickel plating bath of claim 18 further including the step of adjusting the pH to about 4.0 after step e.

21. The improved process for purifying a nickel plating bath of claim 18 further comprising adding up to about 5.0 g/l sodium saccharin.

22. An improved process for purifying a nickel plating bath solution containing a pyridine compound as an additive, the solution containing an impurity comprising a breakdown product of the pyridine composition, comprising the steps of:
a. adding sodium bicarbonate to said bath for adjusting the pH of said bath from about 5.0 to about 6.0;
b. adding less than 10 g/l sodium perborate to said bath;
c. adding less than 0.5 g/l potassium permanganate to said bath;
d. adding less than 10 g/l activated carbon to said bath;
e. stirring said bath;
f. filtering said bath for removing precipitants from said bath;
g. adjusting the pH of said bath to about 4.0;
h. adding less than about 5 g/l sodium saccharin to said bath; and
i. thereafter replenishing said bath with nickel plating components.

* * * * *